US009717375B2

(12) United States Patent
Pelfrey

(10) Patent No.: US 9,717,375 B2
(45) Date of Patent: Aug. 1, 2017

(54) PUSH PAD DISPENSER

(71) Applicant: GOJO Industries, Inc., Akron, OH (US)

(72) Inventor: Keith A. Pelfrey, Wadsworth, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 99 days.

(21) Appl. No.: 14/569,901

(22) Filed: Dec. 15, 2014

(65) Prior Publication Data

US 2015/0164286 A1 Jun. 18, 2015

Related U.S. Application Data

(60) Provisional application No. 61/917,062, filed on Dec. 17, 2013.

(51) Int. Cl.
*A46B 11/00* (2006.01)
*A47K 7/03* (2006.01)
*A47K 5/12* (2006.01)

(52) U.S. Cl.
CPC ..... *A47K 7/03* (2013.01); *A47K 5/1208* (2013.01); *A47K 5/1211* (2013.01); *A45D 2200/1018* (2013.01)

(58) Field of Classification Search
CPC ..... A47K 5/1211; A45D 2200/1018; A45D 2200/1027
USPC ..... 401/188 R, 207
See application file for complete search history.

(56) References Cited

U.S. PATENT DOCUMENTS 6,158,674 A * 12/2000 Humphreys ..... B05B 1/14 222/321.6
6,457,893 B1 * 10/2002 Hamilton ..... A45D 34/04 222/192
6,592,282 B2 * 7/2003 Fontanet ..... A45D 34/04 401/188 R
6,629,799 B2 * 10/2003 Flores, Jr. ..... A47K 5/1202 15/104.92
6,736,562 B2 * 5/2004 Whitmore ..... A47K 5/12 222/192
7,004,659 B1 * 2/2006 Goodman ..... B05C 17/002 222/633
7,264,414 B2 * 9/2007 McReynolds ..... A47L 1/15 401/136
7,578,388 B2 * 8/2009 O'Connell ..... B05C 17/002 206/223

(Continued)

*Primary Examiner* — Jennifer C Chiang
(74) *Attorney, Agent, or Firm* — Cooper Legal Group, LLC

(57) ABSTRACT

A dispensing system includes a housing including a cover portion attached to a base portion. The cover portion includes an opening. The dispensing system includes a dispensing assembly within which a material is contained and from which the material is dispensed. The dispensing assembly is supported within an interior of the base portion and in fluid communication with the opening. At least one of the cover portion is movable relative to the base portion or the base portion is moveable relative to the cover portion. A position of the cover portion relative to the base portion is adjusted between a first position, in which the cover portion does not engage the dispensing assembly such that the material is not dispensed through the opening, and a second position, in which the cover portion engages the dispensing assembly such that the material is dispensed through the opening.

22 Claims, 6 Drawing Sheets

(56) References Cited

U.S. PATENT DOCUMENTS

| | | | | |
|---|---|---|---|---|
| 7,984,832 | B2 * | 7/2011 | Pivonka | A45D 34/04 222/205 |
| 8,167,510 | B2 * | 5/2012 | LaFlamme | A45D 34/04 401/188 R |
| 8,267,610 | B2 * | 9/2012 | Goodman | B05C 17/002 222/183 |

* cited by examiner

PUSH PAD DISPENSER

CROSS-REFERENCE TO RELATED APPLICATIONS

This application claims priority to U.S. Patent Application No. 61/917,062, filed on Dec. 17, 2013, the entire disclosure of which is hereby incorporated by reference.

TECHNICAL FIELD

The instant application is directed towards a dispensing system. For example, the instant application is directed towards a dispensing system for dispensing a material.

BACKGROUND

Dispensing systems can store and selectively dispense a sanitizing material (e.g., soap, hand sanitizer, cleaners, disinfectants, moisturizers etc.). As such, dispensing systems are commonly used in a number of different environments to improve sanitation and cleanliness, for example. Dispensing systems can be used, for example, in schools, hospitals, factories, restaurants, banks, grocery stores, etc., whereupon a user of the dispensing system can clean his/her hands, clean an area within one of these environments, or the like.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a dispensing system comprises a housing comprising a cover portion attached to a base portion. The cover portion comprises an opening. The dispensing system comprises a dispensing assembly within which a material is contained and from which the material is dispensed. The dispensing assembly is supported within an interior of the base portion and in fluid communication with the opening of the cover portion. At least one of the cover portion is movable relative to the base portion or the base portion is moveable relative to the cover portion such that a position of the cover portion relative to the base portion is adjusted between a first position, in which the cover portion does not engage the dispensing assembly such that the material is not dispensed through the opening, and a second position, in which the cover portion engages the dispensing assembly such that the material is dispensed through the opening.

In another example, a dispensing system comprises a housing comprising a cover portion attached to a base portion. The cover portion comprises an opening. The dispensing system comprises a dispensing assembly within which a material is contained and from which the material is dispensed. The dispensing assembly is supported within an interior of the base portion and in fluid communication with the opening of the cover portion. The dispensing assembly comprises a pump, wherein at least one of the cover portion is movable relative to the base portion or the base portion is moveable relative to the cover portion such that a position of the cover portion relative to the base portion is adjusted between a first position, in which the cover portion does not engage the pump such that the material is not dispensed through the opening, and a second position, in which the cover portion engages the pump such that the material is dispensed through the opening.

In another example, a method for operating a dispensing system comprises receiving a dispensing assembly within a base portion of a housing. The method comprises, responsive to movement of at least one of a cover portion of the housing relative to the base portion or of the base portion relative to the cover portion such that the cover portion engages the dispensing assembly, dispensing material from the dispensing assembly through an opening in the cover portion.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
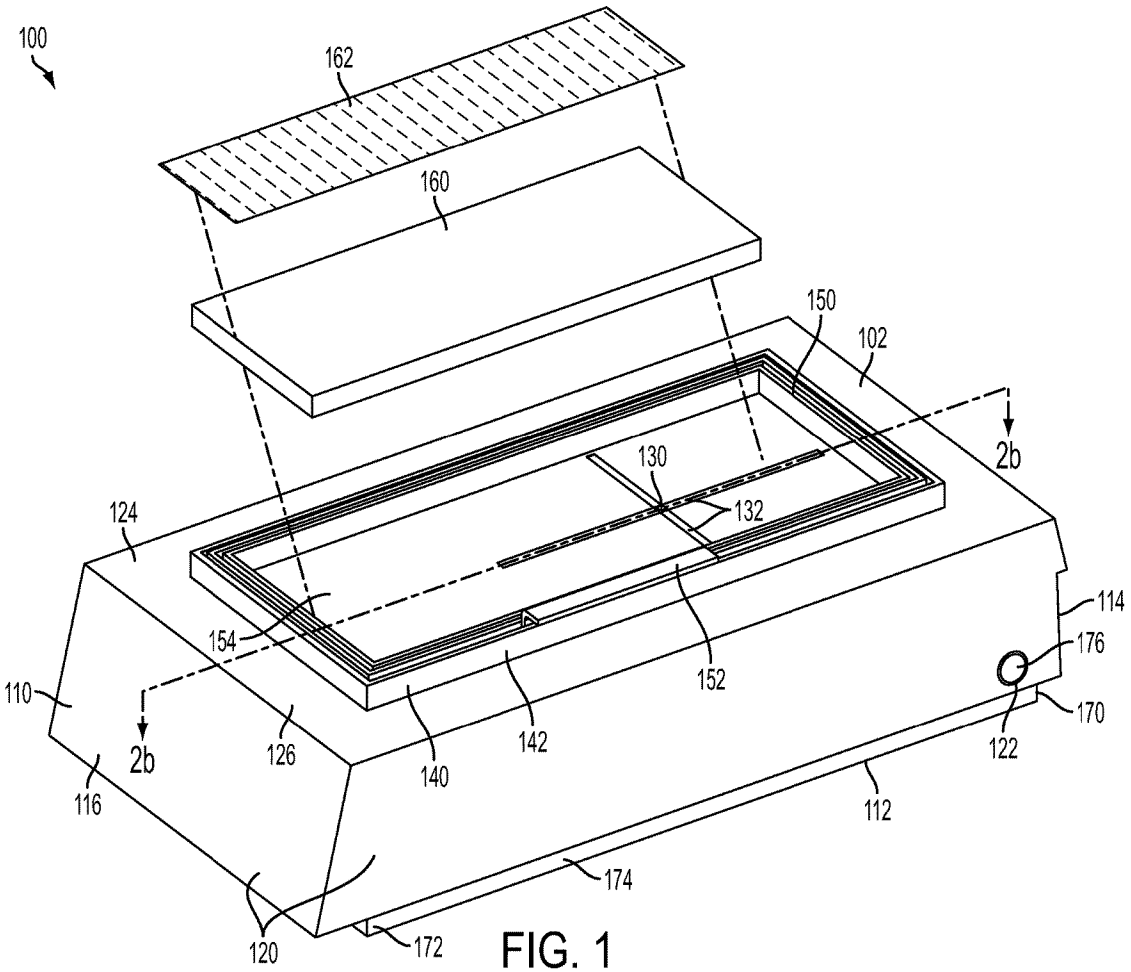
FIG. 1 is an illustration of an example dispensing system.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

Turning to FIG. 1, a dispensing system 100 is illustrated. In an example, the dispensing system 100 can be used for storing and or dispensing a material (e.g., sanitizers, antiseptics, soaps, moisturizers, or the like). The dispensing system 100 can be used in association with any number of applications and/or environments, such as personal hygiene, retail cashiers (e.g., grocery stores, etc.), bank tellers, hospitals, warehouses, schools, homes, businesses, etc.

The dispensing system 100 comprises a housing 102. The housing 102 can comprise, for example, a cover portion 110 and a base portion 112. The cover portion 110 can extend between a first end 114 and a second end 116. The first end 114 of the cover portion 110 is movably attached to the base portion 112. In some examples, the housing 102 (comprising the cover portion 110 and base portion 112) has a substantially rectangular shape. The housing 102 is not so limited, however, and, instead, may comprise any number of sizes, shapes, and constructions, including, but not limited to, quadrilateral shapes (square shape, etc.), rounded shapes, ovoid shapes, circular shapes, or the like. Similarly, the housing 102 is not limited to the illustrated size of FIG. 1, and in some examples, may be larger or smaller than is shown.

The cover portion 110 can comprise one or more lateral walls 120 that, together, define a perimeter of the cover portion 110. The walls 120 of the cover portion 110 comprise any number of materials, comprising, but not limited to, plastics, polypropylene, metals, or other relatively rigid materials. The cover portion 110 can comprise one or more attachment openings 122. In the illustrated example, the cover portion 110 comprises two attachment openings 122 that extend through opposing lateral walls 120. The attachment openings 122 can be positioned at the first end 114 of the cover portion 110 though, in other examples, the attachment openings 122 can be positioned at the second end 116.

The cover portion 110 comprises an outer surface 124 located on a top wall 126 at a top of the cover portion 110. The outer surface 124 defines a substantially flat, planar surface. The top wall 126 that defines the outer surface 124 is attached (e.g., formed with, separately attached to, molded to, etc.) to the lateral walls 120. As such, the lateral walls 120 and top wall 126 together define an interior of the cover portion 110.

The cover portion 110 comprises an opening 130 that extends through the outer surface 124 of the top wall 126 of the cover portion 110. In an example, the opening 130 extends between an interior of the cover portion 110 and an exterior. The opening 130 comprises any number of sizes and shapes, though, in at least one example, the opening 130 is large enough to allow for the passage of fluid(s) therethrough. In some examples, the cover portion 110 comprises one or more channels 132 that extend along the outer surface 124. The channels 132 define one or more grooves, furrows, indentations, or the like that extend into the outer surface 124. At least a portion of each of the channels 132 can be positioned adjacent and/or in contact with the opening 130. The channels 132 comprise any number of sizes and shapes, such that the channels 132 are not limited to the cross-like shape of FIG. 1. In some examples, the opening 130 comprises a manifold that can be attached to one or more pipes, channels, etc. (e.g., conduit 222).

The cover portion 110 can comprise a retention frame 140. The retention frame 140 can be positioned on the outer surface 124 of the top wall 126. In some examples, the retention frame 140 can be attached to the outer surface 124, such as by adhesives or the like. In other examples, however, the retention frame 140 can be formed with (e.g., molded with) the outer surface 124 such that the cover portion 110 and retention frame 140 are a one-piece formed structure. The retention frame 140 comprises a plurality of retention walls 142 that define a raised surface on the outer surface 124. In the illustrated example, the retention walls 142 are arranged in a substantially rectangular shape, though any number of sizes, shapes, and constructions are envisioned. For example, the retention walls 142 of the retention frame 140 can be larger or smaller than as illustrated or, in other examples, could have other shapes, such as quadrilateral shapes (e.g., square), rounded shapes, ovoid shapes, circular shapes, etc.

In some examples, the cover portion 110 comprises a retaining structure 150. The retaining structure 150 is movably attachable with respect to the outer surface 124 of the cover portion 110. For example, the retaining structure 150 is movably attached with respect to the retention frame 140, such as by being pivotably attached. In an example, the retaining structure 150 has a size and/or shape that substantially matches the shape of the retention frame 140, such that the retaining structure 150 can be received within the retention frame 140. In such an example, the retaining structure 150 comprises a substantially rectangular shape, though any number of sizes, shapes, and constructions are substantially, comprising quadrilateral shapes (e.g., square), rounded shapes, ovoid shapes, circular shapes, etc.

In the illustrated example, the retaining structure 150 can comprise a handle 152. The handle 152 can be located, for example, opposite the attachment location of the retaining structure 150 and the retention frame 140. As such, a user can grasp the handle 152 such that the retaining structure 150 is movable between an open position (illustrated in FIG. 4) and a closed position (illustrated in FIG. 1). In some examples, the retaining structure 150 has an opening 154 extending through the retaining structure 150.

Figure 4:
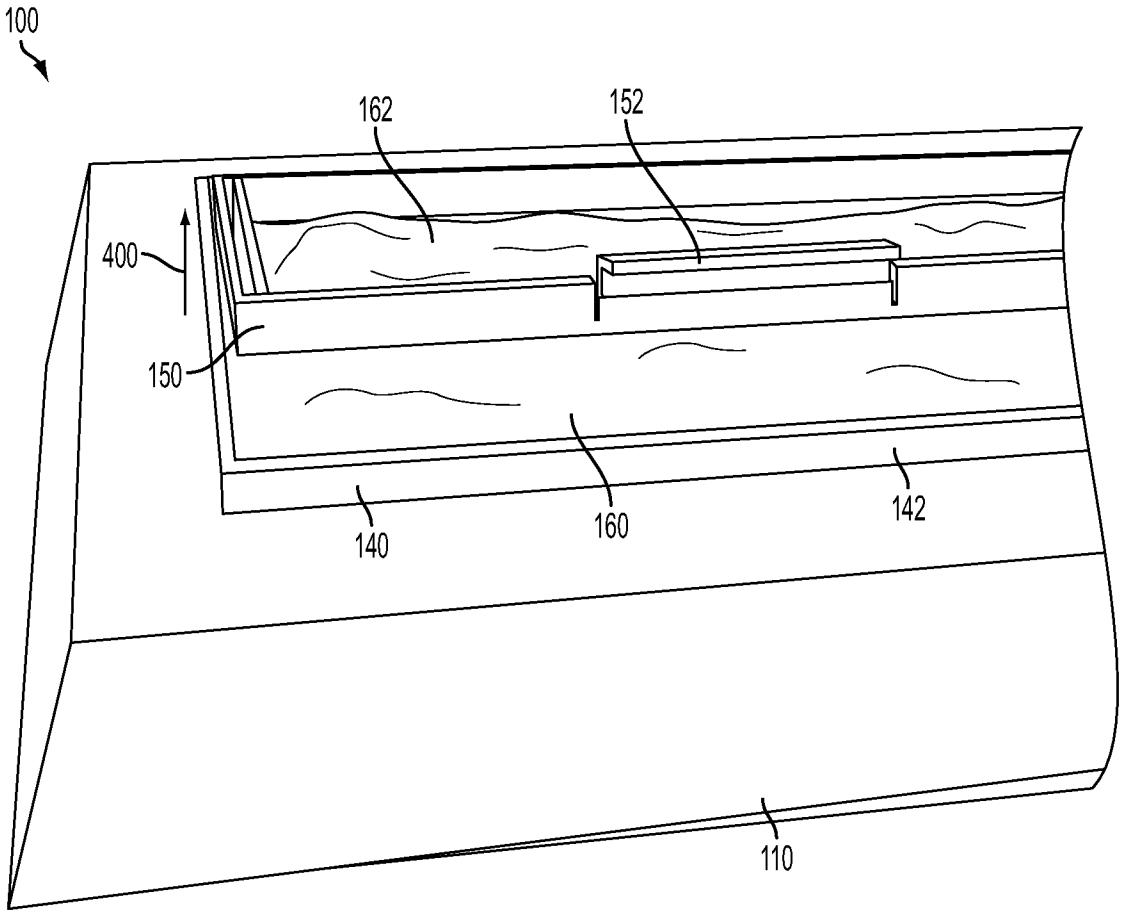
FIG. 4 is an illustration of an example dispensing system.

The dispensing system 100 can comprise an absorbent media 160. It will be appreciated that the absorbent media 160 is illustrated as being separated from the cover portion 110 for ease of illustration. In operation, however, the absorbent media 160 can be placed within the retention frame 140 (as illustrated in FIG. 4). The absorbent media 160 comprises any number of materials that exhibit at least some degree of absorption, comprising, in some examples, sponges, clothes, woven or nonwoven materials, etc. While the absorbent media 160 comprises any number of sizes and/or shapes, in the illustrated example, the absorbent media 160 can have a shape that substantially matches the retention frame 140, such that the absorbent media 160 can be positioned within the retention frame 140. When positioned within the retention frame 140, the absorbent media 160 can cover the opening 130 and the channels 132 of the cover portion 110.

In some examples, the dispensing system 100 can comprise a permeable cover 162. As with the absorbent media 160, the permeable cover 162 is illustrated as being separated from the cover portion 110 for ease of illustration. In operation, however, the permeable cover 162 can be placed within the retention frame 140 (as illustrated in FIG. 4) on top of (e.g., covering) the absorbent media 160. As such, the absorbent media 160 can be positioned between the permeable cover 162 on one side and the cover portion 110 on an opposing second side. The permeable cover 162 can comprise one or more openings 164 through which liquid from the absorbent media 160 can flow. In one possible example, the openings 164 in the permeable cover 162 can be selectively opened and/or enlarged in response to a user applying a force to the permeable cover 162, such that the liquid can selectively flow from the absorbent media and through the permeable cover 162.

Referring still to FIG. 1, the housing 102 can comprise a base portion 112. In an example, the cover portion 110 can be attached to the base portion 112. The base portion 112 has a cross-sectional size and/or shape that is smaller than the cover portion 110, such that the base portion 112 can be received within the cover portion 110. The base portion 112 can extend between a first end 170 and an opposing second end 172. The first end 170 of the base portion 112 is movably attached to the cover portion 110. In some examples, the base portion 112 has a substantially rectangular shape, though, in other examples, may comprise any number of sizes, shapes, and constructions, comprising, but not limited to, quadrilateral shapes (square shape, etc.), rounded shapes, ovoid shapes, circular shapes, or the like. Similarly, the base portion 112 is not limited to the illustrated size of FIG. 1, and in some examples, may be larger or smaller than as shown.

The base portion 112 can comprise one or more lateral walls 174 that, together, define a perimeter of the base portion 112. The base portion 112 comprises any number of materials, comprising, but not limited to, plastics, polypropylene, metals, or other relatively rigid materials. The base portion 112 can comprise one or more attachment structures 176. In the illustrated examples, the base portion 112 comprises two attachment structures 176 that project outwardly from opposing lateral walls 174. The attachment structures 176 can be positioned at the first end 170 of the base portion 112 though, in other examples, the attachment structures 176 can be positioned at the second end 172.

The attachment structures 176 can comprise a size and/or shape that substantially matches and/or is smaller than the size and/or shape of the attachment opening 122. In this example, the attachment structures 176 can extend through the attachment openings 122. As such, the cover portion 110 and the base portion 112 are movably attached with respect to each other. In an example, the first end 114 of the cover portion 110 is pivotable relative to the base portion 112. In the illustrated example, the attachment openings 122 and attachment structures 176 comprise a pivot hinge, such that that first end 114 of the cover portion 110 is attached to the base portion 112 by a pivot hinge. In other examples, however, the first end 114 of the cover portion 110 is attached to the base portion 112 by a living hinge. In such an example, the cover portion 110 and base portion 112 may not comprise the attachment openings 122 or the attachment structures 176, such that a living hinge attaches the cover portion 110 to the base portion 112.

Figure 2A:
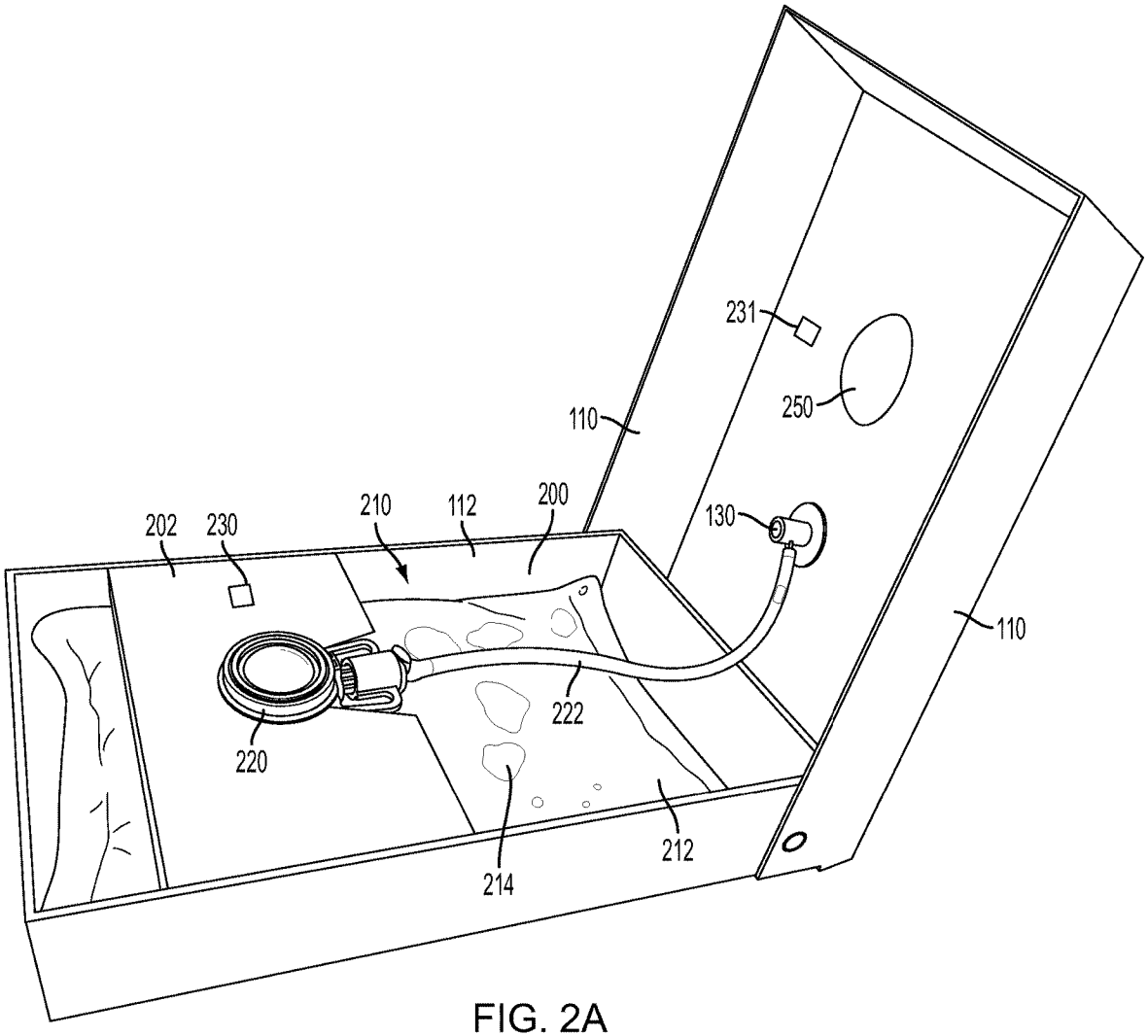
FIG. 2A is an illustration of an example dispensing system in an open position.
Figure 2B:
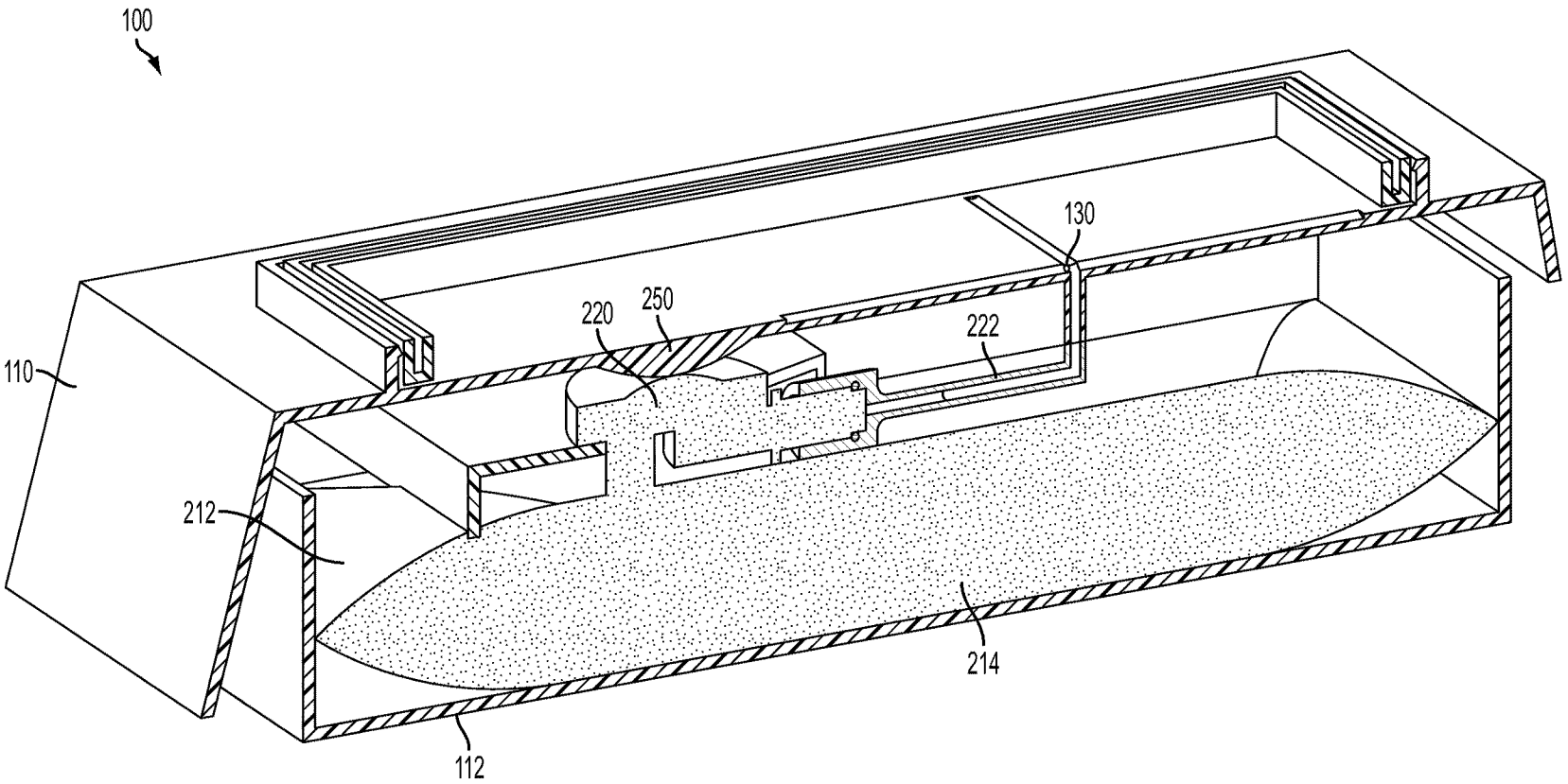
FIG. 2B is an illustration of a sectional view of an example dispensing system.

Turning now to FIGS. 2A and 2B, an interior 200 of the base portion 112 is illustrated. FIG. 2A illustrates the interior 200 of the base portion 112 when the cover portion 110 is moved to an open position with respect to the base portion 112. FIG. 2B illustrates a sectional view of the dispensing system 100 along lines 2B-2B of FIG. 1.

The interior 200 of the base portion 112 is substantially hollow. The base portion 112 can comprise a support wall 202 that extends across the interior 200 of the base portion 112 between opposing lateral walls 174. In an example, the support wall 202 covers a portion of the base portion 112, such that the interior 200 can be selectively accessed.

The dispensing system 100 can comprise a dispensing assembly 210 that is supported within the interior 200 of the base portion 112. In some examples, the dispensing assembly 210 comprises a container 212 that can store a material 214. The container 212 is substantially hollow, such that the material 214 can be stored within the container 212. The container 212 comprises any number of types of containers, comprising rigid containers, bottles, etc., or flexible pouches, film bags, or the like. Likewise, the container 212 comprises any number of sizes, comprising a 500 mL size, or the like.

The material 214, contained within the container 212 of the dispensing assembly 210, can be selectively dispensed. The material 214 comprises any number of liquid, semi-liquid, gel, powder, foam based materials, etc. The material 214 can comprise, for example, cleaning materials such as sanitizers, antiseptics, antibactaterials, soaps, moisturizers, or the like. In other examples, the material 214 may comprise water or other non-cleaning liquid materials. Indeed, the material 214 is not specifically limited to these examples, and could comprise any number of types of materials.

The dispensing assembly 210 comprises a pump 220 attached with respect to the container 212. The pump 220 can function to move and/or expel the material 214 from the container 212. In some examples, the pump 220 is supported by the support wall 202. The pump 220 is in fluid communication with the material 214, such that, in response to a force, the material 214 can be moved and/or expelled from the container 212. The pump 220 illustrated in FIGS. 2A and 2B comprises only one of any number of pumps. Indeed, the pump 220 can comprise a bellows pump, dome pump, or the like.

The dispensing assembly 210 can comprise a conduit 222. The conduit 222 comprises a tube, hose, channel, or the like that extends between the container 212 and the opening 130 of the cover portion 110. The conduit 222 comprises any number of constructions and/or designs, such as by being longer or shorter than as illustrated, or by comprising valves, nozzles, spigots, or the like. In the illustrated example, the conduit 222 is attached adjacent the pump, and is in fluid communication with the interior of the container 212. As such, the conduit 222 defines a flow path along which the material 214 can flow from the container 212, through the conduit 222, and to/through the opening 130. Accordingly, the dispensing assembly 210 is in fluid communication with the opening 130 of the cover portion 110.

In some examples, the dispensing assembly 210 is removable from within the interior 200 of the base portion 112. In an example, the pump 220 can be separated and/or detached from the support wall 202, such that portions of the dispensing assembly 210 (e.g., container 212, pump 220, conduit 222) can be removed from the interior 200. Upon being removed, the dispensing assembly 210, in particular, the container 212, can be refilled with material 214. As such, the dispensing assembly 210 can be selectively removed, refilled, and replaced.

The cover portion 110 can comprise a projection 250 that projects inwardly from an inner surface top wall 126 towards the interior 200 of the base portion 112. The projection 250 comprises any number of sizes and shapes. In the illustrated example, the projection 250 comprises a rounded shape, though other shapes are envisioned. In an example, the projection 250 projects towards the interior 200 to a greater degree than surrounding portions of the top wall 126. The projection 250 can be located along the top wall 126 in a position that substantially matches the position of the pump 220. As such, the projection 250 can selectively engage the pump 220. In an example, the projection 250 of the cover portion 110 engages the pump 220 when the cover portion 110 and base portion 112 are moved closer into contact with each other.

In an example, one or more biasing devices 230, 231 can be provided to assist in biasing the cover portion 110 and the base portion 112 to a desired position. In the illustrated example, the one or more biasing devices 230, 231 can assist in biasing the cover portion 110 and the base portion 112 away from one another from the position illustrated in FIG. 3 to the position illustrated in FIG. 1. The biasing devices 230, 231 comprise any number of biasing devices that can exert a force. For example, the biasing devices 230, 231 can comprise springs, magnets, or the like.

In a possible example, a first biasing device 230 is disposed on an upper surface of the support wall 202 of the base portion 112. In such an example, a second biasing device 231 can be disposed on a bottom surface of the cover portion 110, such as in proximity to the projection 250. The first biasing device 230 and the second biasing device 231 can be positioned so as to be aligned and/or in contact when the cover portion 110 and the base portion 112 are moved to the position illustrated in FIG. 3. In this example, the first biasing device 230 and the second biasing device 231 comprise magnets with like polarities facing one another. For example, a north pole or south pole of one of the first biasing device 230 or the second biasing device 231 may be oriented to face towards a north pole or south pole, respectively, of the other of the first biasing device 230 or the second biasing device 231.

Figure 3:
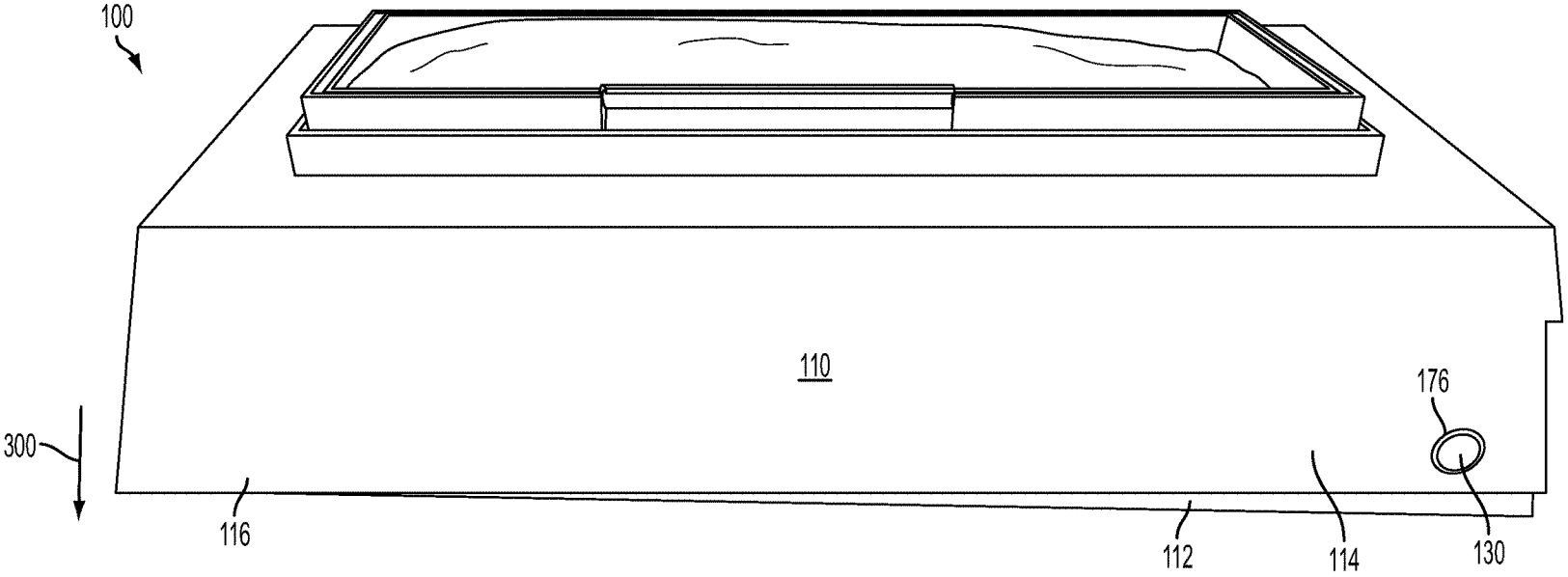
FIG. 3 is an illustration of an example dispensing system.

In an example, the north pole of the first biasing device 230 can be oriented to face upwards towards the cover portion 110 while the north pole of the second biasing device 231 can be oriented to face downwards towards the base portion 112. Alternatively, the south pole of the first biasing device 230 can be oriented to upwards toward the cover potion 110 while the south pole of the second biasing device 231 can be oriented to face downwards towards the base portion 112. As such, when the cover portion 110 and the base portion 112 are brought into close contact (e.g., as illustrated in FIG. 3), the first biasing device 230 and the second biasing device 231 are moved into proximity and/or contact with one another. As such, due to the first biasing device 230 and the second biasing device 231 repelling one another, the cover portion 110 and the base portion 112 can be biased away from one another.

In another example, either or both of the first biasing device 230 and the second biasing device 231 can be provided. For example, the first biasing device 230 and/or the second biasing device 231 can comprise a spring, such as a helical spring. In a possible example, the first biasing device 230 can act upon (e.g., apply a force to) the bottom surface of the cover portion 110 when the cover portion 110 and the base portion 112 are brought into close contact (e.g., as illustrated in FIG. 3), such that the cover portion 110 and the base portion 112 can be biased away from one another. In addition or in the alternative, the second biasing device 231 can act upon (e.g., apply a force to) the upper surface of the support wall 202 of the base portion 112 when the cover portion 110 and the base portion 112 are brought into close contact (e.g., as illustrated in FIG. 3), such that the cover portion 110 and the base portion 112 can be biased away from one another.

It will be appreciated that in this example, both the first biasing device 230 and the second biasing device 231 need not be provided. Rather, the base portion 112 can be provided with the first biasing device 230 while the cover portion 110 may not be provided with the second biasing device 231. Alternatively, the cover portion 110 can be provided with the second biasing device 231 while the base portion 112 may not be provided with the first biasing device 230.

In the aforementioned examples, the first biasing device 230 and/or the second biasing device 231 are not limited to their illustrated positions. Rather, the first biasing device 230 and/or the second biasing device 231 can be positioned at nearly any location on the cover portion 110 and/or the base portion 112, provided that the first biasing device 230 and/or the second biasing device 231 function to bias the cover portion 110 and the base portion 112 away from one another. Additionally, the first biasing device 230 and the second biasing device 231 are illustrated schematically with black boxes, as it is understood that the biasing devices 230, 231 comprise any number of structures and/or devices (e.g., springs, magnets, etc.). In another example, the biasing device comprises a torsion spring that is attached to, wrapped around, etc. the attachment structures 176. In such an example, the torsion spring can function to bias the cover portion 110 and the base portion 112 away from one another.

Turning now to FIG. 3, at least one of the cover portion 110 is movable relative to the base portion 112 or the base portion 112 is moveable relative to the cover portion 110. As such, a position of the cover portion 110 relative to the base portion 112 is adjustable. In the illustrated example of FIGS. 1 and 2B, the cover portion 110 relative to the base portion 112 is in a first position. In the first position, the cover portion 110 (e.g., projection 250) does not engage the dispensing assembly 210 (e.g., the pump 220) such that the material 214 is not dispensed through the opening 130. As illustrated in FIG. 2B, in the first position, the projection 250 does not depress the pump 220, such that the material 214 is not forced through the conduit 222 and through the opening 130.

In the illustrated example of FIG. 3, the cover portion 110 relative to the base portion 112 is in a second position. In this example, the second end 116 of the cover portion 110 is moved in a movement direction 300 towards the base portion 112. The cover portion 110 can be moved in the movement direction 300 in any number of ways, such as in response to a force applied by a user. For example, the user can push on the absorbent media 160 and/or the outer surface 124 of the top wall 126, such that the cover portion 110 pivots with respect to the base portion 112. In response to this force, the second end 116 of the cover portion 110 can move towards the base portion 112.

In the second position, the cover portion 110 (e.g., projection 250) engages the dispensing assembly 210 (e.g., the pump 220) such that the material 214 is not dispensed through the opening 130. In an example, the projection 250 of the cover portion 110 engages and depresses the pump 220 when the position of the cover portion 110 relative to the base portion 112 is in the second position. As such, the material 214 is forced through the conduit 222 and through the opening 130. In some examples, after the material 214 is dispensed, the position of the cover portion 110 relative to the base portion 112 is reverted to the first position (e.g., illustrated in FIGS. 1 and 2B) such that the cover portion 110 does not engage the dispensing assembly 210.

As the material 214 flows through and exits the opening 130, the material 214 can flow along the channels 132 in the outer surface 124 of the top wall 126. The material 214 that exits the opening 130 and flows along the channels 132 can be at least partially absorbed by the absorbent media 160. As such, a user can touch and/or compress the absorbent media 160, such that some of the material 214 that has been absorbed by the absorbent media 160 is extracted and/or drawn out onto the user's hand or fingers. This material 214, which may comprise a sanitizer, can then be used to clean the user's hand(s).

Turning now to FIG. 4, the absorbent media 160 can be selectively removed from the dispensing system 100 and/or replaced. In an example, the absorbent media 160 is removably supported on the outer surface 124 of the cover portion 110 over the opening 130. The retaining structure 150 is movable between an open position (illustrated in FIG. 4) and a closed position (illustrated in FIGS. 1 and 2B). The absorbent media 160 is supported between the outer surface 124 of the cover portion 110 and the retaining structure 150 when the retaining structure 150 is in the closed position. For example, the absorbent media 160 and the permeable cover 162 can be sandwiched between the outer surface 124 on one side and the retaining structure 150 on an opposing side. When the retaining structure 150 is in the closed position, the absorbent media 160 and permeable cover 162 are substantially limited from being inadvertently removed.

The absorbent media 160 and/or the permeable cover 162 can be removed when the retaining structure 150 is moved to the open position. For example, as illustrated in FIG. 4, the retaining structure 150 can be moved in an opening direction 400. The user can grasp the handle 152 of the retaining structure 150 and pull the retaining structure 150, thus causing the retaining structure 150 to move (e.g., pivot) with respect to the retention frame 140. As the retaining structure 150 moves in the opening direction 400, the absorbent media 160 and permeable cover 162 are no longer sandwiched and/or positioned between the retaining structure 150 and the outer surface 124. Rather, the absorbent media 160 and permeable cover 162 can be freely removed. After the absorbent media 160 and/or permeable cover 162 are removed, a user can replace the absorbent media 160 and/or permeable cover 162.

Figure 5:
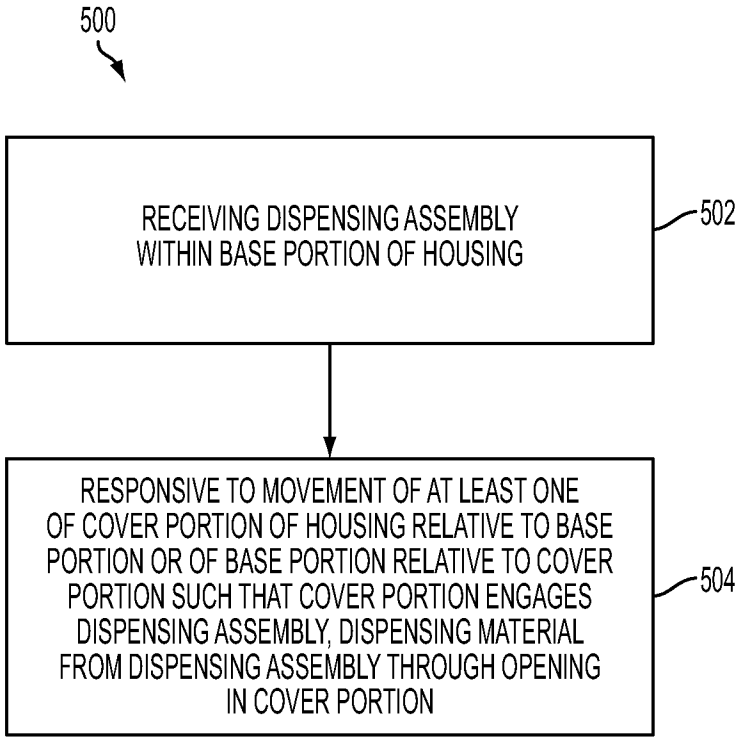
FIG. 5 is an illustration of an example method for operating a dispensing system.

Turning now to FIG. 5, an example method 500 of operating the dispensing system 100 is illustrated. The method 500 can be used in association with some or all of the features illustrated in FIGS. 1 to 4. At 502, the method 500 comprises receiving the dispensing assembly 210 within the base portion 112 of the housing 102. At 504, the method comprises, responsive to movement of at least one of the cover portion 110 of the housing 102 relative to the base portion 112 or of the base portion 112 relative to the cover portion 110 such that the cover portion 110 engages the dispensing assembly 210, dispensing the material 214 from the dispensing assembly 210 through the opening 130 in the cover portion 110.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A dispensing system comprising:

a housing comprising a cover portion attached to a base portion, the cover portion comprising an opening; and a dispensing assembly within which a material is contained and from which the material is dispensed, the dispensing assembly supported within an interior of the base portion and in fluid communication with the opening of the cover portion, wherein at least one of the cover portion is movable relative to the base portion or the base portion is moveable relative to the cover portion such that a position of the cover portion relative to the base portion is adjusted between a first position, in which the cover portion does not engage the dispensing assembly such that the material is not dispensed through the opening and a first axis passing through the cover portion is parallel to a second axis passing through the base portion, a second position, in which the cover portion engages the dispensing assembly such that the material is dispensed through the opening and the first axis is not parallel to the second axis, and an open position, in which the dispensing assembly is supported within the interior of the base portion and not the cover portion.

2. The dispensing system of claim 1, wherein an absorbent media is removably supported on an outer surface of the cover portion over the opening.

3. The dispensing system of claim 2, wherein a retaining structure is movably attached with respect to the outer surface of the cover portion, the retaining structure movable between an open position and a closed position.

4. The dispensing system of claim 3, wherein the absorbent media is supported between the outer surface of the cover portion and the retaining structure when the retaining structure is in the closed position.

5. The dispensing system of claim 1, wherein the cover portion extends between a first end and a second end, the first end of the cover portion movably attached to the base portion.

6. The dispensing system of claim 5, wherein the first end of the cover portion is attached to the base portion by a pivot hinge.

7. The dispensing system of claim 5, wherein the first end of the cover portion is pivotable relative to the base portion.

8. The dispensing system of claim 1, wherein the dispensing assembly is removable from within the interior of the base portion.

9. The dispensing system of claim 1, wherein the cover portion extends between a first end and a second end, the first end of the cover portion pivotably attached to the base portion and the second end of the cover portion movable relative to the base portion based upon the cover portion being pivotably attached to the base portion.

10. A dispensing system comprising:

a housing comprising a cover portion attached to a base portion, the cover portion comprising an opening, the base portion comprising:

a bottom wall; and a support wall extending substantially parallel to and spaced apart from the bottom wall to define an interior of the base portion; and a dispensing assembly comprising:

a container having a sidewall that is deformable and within which a material is contained and from which the material is dispensed, the container supported within the interior of the base portion between the bottom wall and the support wall, and in fluid communication with the opening of the cover portion through a pump; and the pump received within a support opening defined within the support wall such that the pump is supported by the support wall and in fluid communication with the container and the opening of the cover portion, wherein at least one of the cover portion is movable relative to the base portion or the base portion is moveable relative to the cover portion such that a position of the cover portion relative to the base portion is adjusted between a first position, in which the cover portion does not engage the pump such that the material is not dispensed through the opening, and a second position, in which the cover portion engages the pump such that the material is dispensed through the opening and the sidewall is deformed.

11. The dispensing system of claim 10, wherein an absorbent media is removably supported on an outer surface of the cover portion over the opening.

12. The dispensing system of claim 11, wherein a retaining structure is movably attached with respect to the outer surface of the cover portion, the retaining structure movable between an open position and a closed position.

13. The dispensing system of claim 12, wherein the absorbent media is supported between the outer surface of the cover portion and the retaining structure when the retaining structure is in the closed position.

14. The dispensing system of claim 10, wherein the cover portion comprises a projection that projects inwardly towards the interior of the base portion.

15. The dispensing system of claim 14, wherein the projection of the cover portion engages the pump when the position of the cover portion relative to the base portion is in the second position.

16. The dispensing system of claim 10, wherein a first end of the cover portion is pivotable relative to the base portion.

17. The dispensing system of claim 10, wherein the container comprises at least one of a film bag, pouch or bottle.

18. A method for operating a dispensing system comprising:

receiving a dispensing assembly within a base portion of a housing when the base portion and a cover portion of the housing are in an open position; and responsive to movement of at least one of the cover portion of the housing relative to the base portion or of the base portion relative to the cover portion such that the cover portion engages the dispensing assembly, dispensing material from the dispensing assembly through an opening in the cover portion, the material contained within a container of the dispensing assembly and a sidewall of the container deformed during the dispensing.

19. The method of claim 18, comprising reverting a position of the cover portion relative to the base portion to a first position, after the dispensing, such that the cover portion does not engage the dispensing assembly.

20. The method of claim 18, comprising supporting an absorbent media on an outer surface of the cover portion over the opening.

21. The method of claim 20, comprising using a retaining structure to support the absorbent media on the outer surface of the cover portion.

22. The method of claim 18, comprising attaching the dispensing assembly to an opening in the housing.

* * * * *